United States Patent [19]

Wyser

[11] Patent Number: 4,645,554

[45] Date of Patent: Feb. 24, 1987

[54] APPARATUS AND METHOD FOR ADHERING SUCCESSIVE WEBS BY MEANS OF ADHESIVE APPLIED TO A PREDETERMINED SIDE THEREOF

[75] Inventor: Johann Wyser, Ligerz, Switzerland

[73] Assignee: Stork Brabant B.V., Netherlands

[21] Appl. No.: 765,715

[22] Filed: Aug. 14, 1985

[30] Foreign Application Priority Data

Aug. 14, 1984 [NL] Netherlands ..... 8402506

[51] Int. Cl.[4] ..... B31F 5/00; B65H 19/00

[52] U.S. Cl. ..... 156/159; 156/505; 242/58.3

[58] Field of Search ..... 156/502, 504, 505, 506, 156/304.3, 157, 159; 242/58.4, 58.3, 58.5, 58.1

[56] References Cited

U.S. PATENT DOCUMENTS

| | | | |
|---|---|---|---|
| Re. 29,365 | 8/1977 | Butler, Jr. | 156/504 |
| 4,190,475 | 2/1980 | Marschle | 156/157 |
| 4,219,378 | 8/1980 | Marschle | 156/504 |
| 4,481,053 | 11/1984 | Tokune et al. | 156/504 |

*Primary Examiner*—Michael Ball

*Attorney, Agent, or Firm*—Ostrolenk, Faber, Gerb & Soffen

[57] ABSTRACT

A device and method for interconnecting the trailing end of a first web to a leading end of a second web as f.i. in a printing machine, said device comprising a loop accumulator, suction boxes and spaced guiding rollers capable of being clamped together while being braked, further comprising means for presenting a sticking strip to be applied to always the same face of the webs.

6 Claims, 7 Drawing Figures

APPARATUS AND METHOD FOR ADHERING SUCCESSIVE WEBS BY MEANS OF ADHESIVE APPLIED TO A PREDETERMINED SIDE THEREOF

BACKGROUND OF THE INVENTION

The invention relates to a device for adhering to each other of the trailing (downstream) portion of a first material web (the terminating web) with the leading (upstream) portion of a second material web (the overtaking web), in which each web is guided along a respective guiding roller which is located in a path from a supply roll to an operating place, the adherence being performed during standstill of the webs. Such a device is known in different embodiment in which mostly both webs are directly glued to each other in an overlapping zone as f.i. disclosed in U.S. Pat. No. 4,190,475 MARSCHKE. A well known field of application is a printing machine in which the above mentioned operating place consists of a printing station.

The above indicated and known manner for the interconnection of the webs implies that both faces of the material must be compatible with the applied adhesive substance. This is not always the case, in particular when the printing operation is to be performed upon a specially prepared face of the web which does not accept the adhesive substance (the glue).

SUMMARY OF THE INVENTION

The invention aims at providing a device which renders an interconnection of two subsequent unilaterally glue-applicable webs possible through the application of a sticking strip to a specific face of both webs. This aim is rendered according to the invention by the application of two suction boxes each positioned along the path of one of said webs at a distance upstream with respect to the respective guiding roller, which suction boxes are provided in the center with an anvil for accurately cutting perpendicularly through the seized web, means being provided for clamping the terminating web between the guiding rollers and means for presenting a sticking strip, in which the distances between the clamping place of both rollers on the one hand and the anvil of both suction boxes (measured along the guiding rollers) on the other hand, are equal to each other.

By means of these novel features it is possible to adhere the webs in an overlapping or in a so called abutting connection, thereby using a sticking strip which only enters into contact with one particular face of the material. This means that in a printing machine the face of the web to be printed remains entirely free of any contact with the adhesive substance.

In accordance with a favourable embodiment of the sticking device, simple means are provided for clamping the terminating web between the guiding rollers, namely in that the two guiding rollers are mounted at a short distance above each other, in which the one roller is displaceable to come in touch with the other fixed roller and in that near the fixed roller a brake shoe is mounted displaceable for arresting the terminating web clamped between both rollers.

BRIEF DESCRIPTION OF THE DRAWING

FIG. 1 is a schematic picture of the entry portion of a printing machine, comprising a derrick in which two rolls of web shaped material can be mounted with a sticking unit and further a loop accumulator between them.

DESCRIPTION OF THE PREFERRED EMBODIMENT

Figure 2:
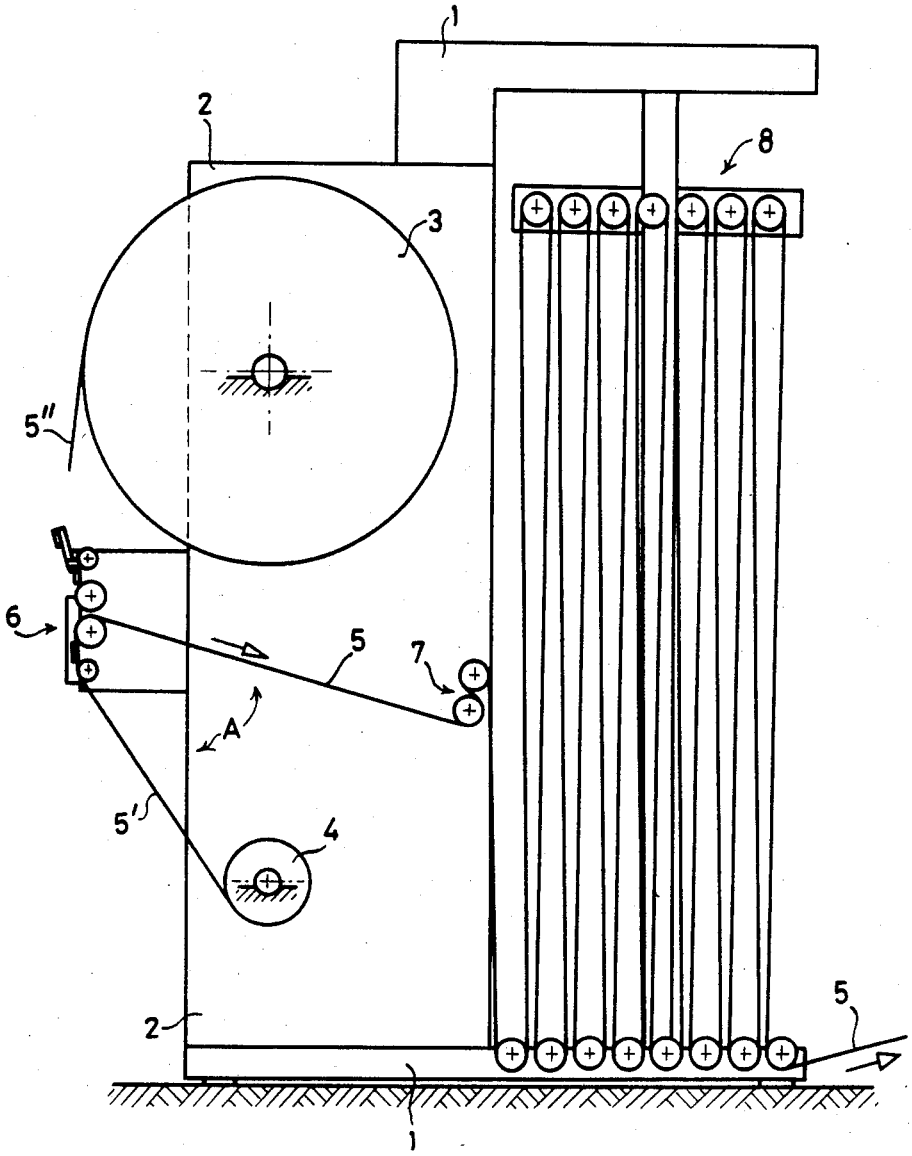
FIG. 2 is a side elevation showing the sticking unit in a preparatory phase.
Figure 2:
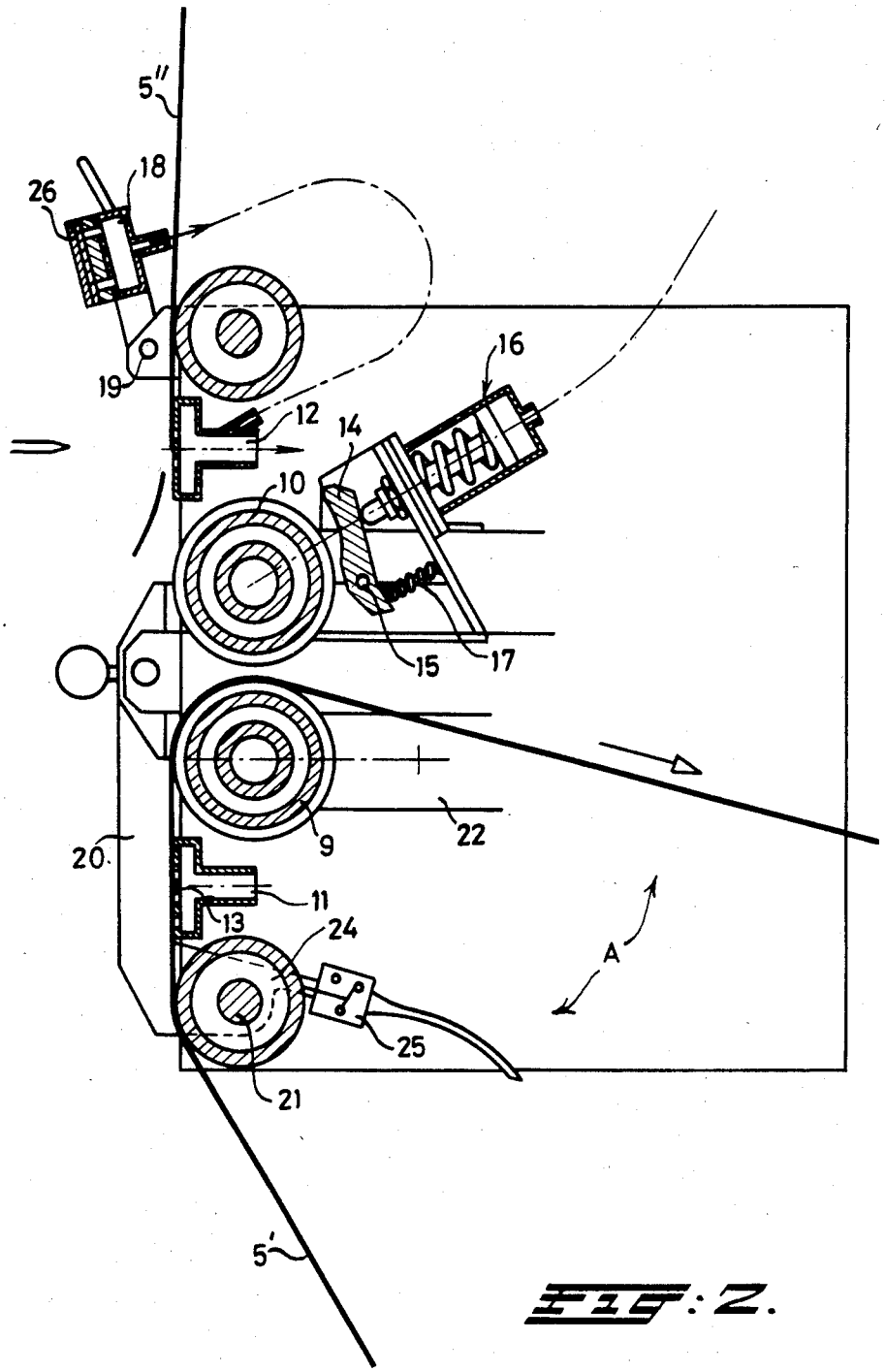

The portion shown in FIG. 1 relates to a printing machine for a material web (for instance paper) which is only on one face suitable for contact with an adhesive substance. The very schematically shown device is provided with a frame 1 comprising a derrick 2 capable for rotatably supporting two rolls 3 and 4 of the material web 5 to be printed. The lower roll 4 delivers in the shown situation the material web 5 through the device 6 to a roller pair 7 forming the entry for a conventional loop accumulator 8. The material web 5 originating from the lower roll 4 forms in the shown embodiment as well as in the FIGS. 2–4 the so called terminating web 5'. The web originating from the full upper roll 3 forms in that case the so called overtaking web 5''. These functions change periodically, depending upon whether the lower roll 4 or the upper roll 3 delivers the web 5 towards the printing machine (not shown).

Figure 3:
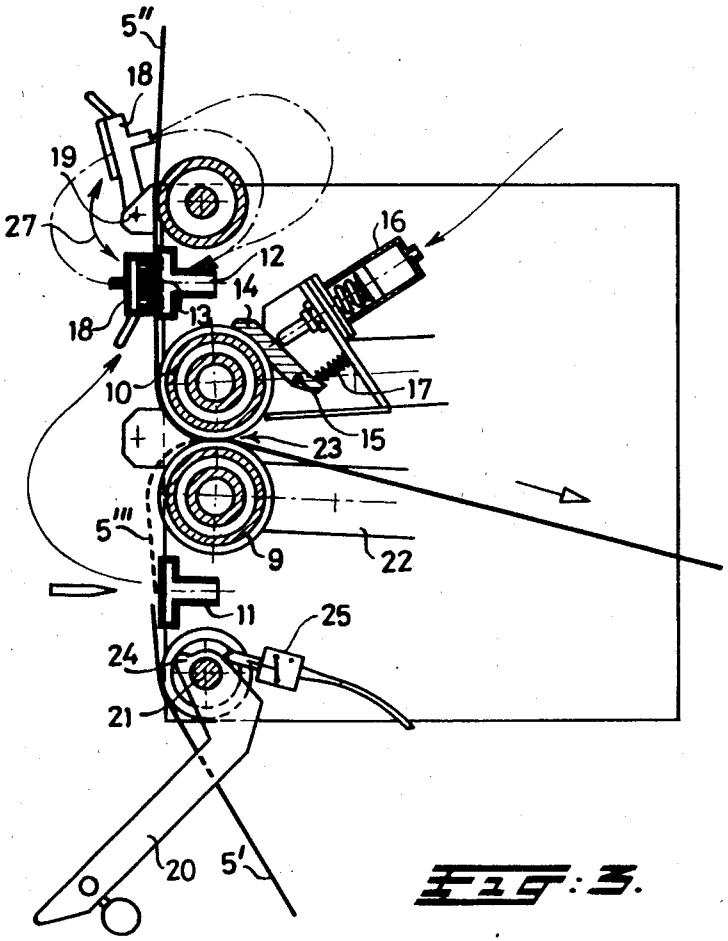
Figure 5:
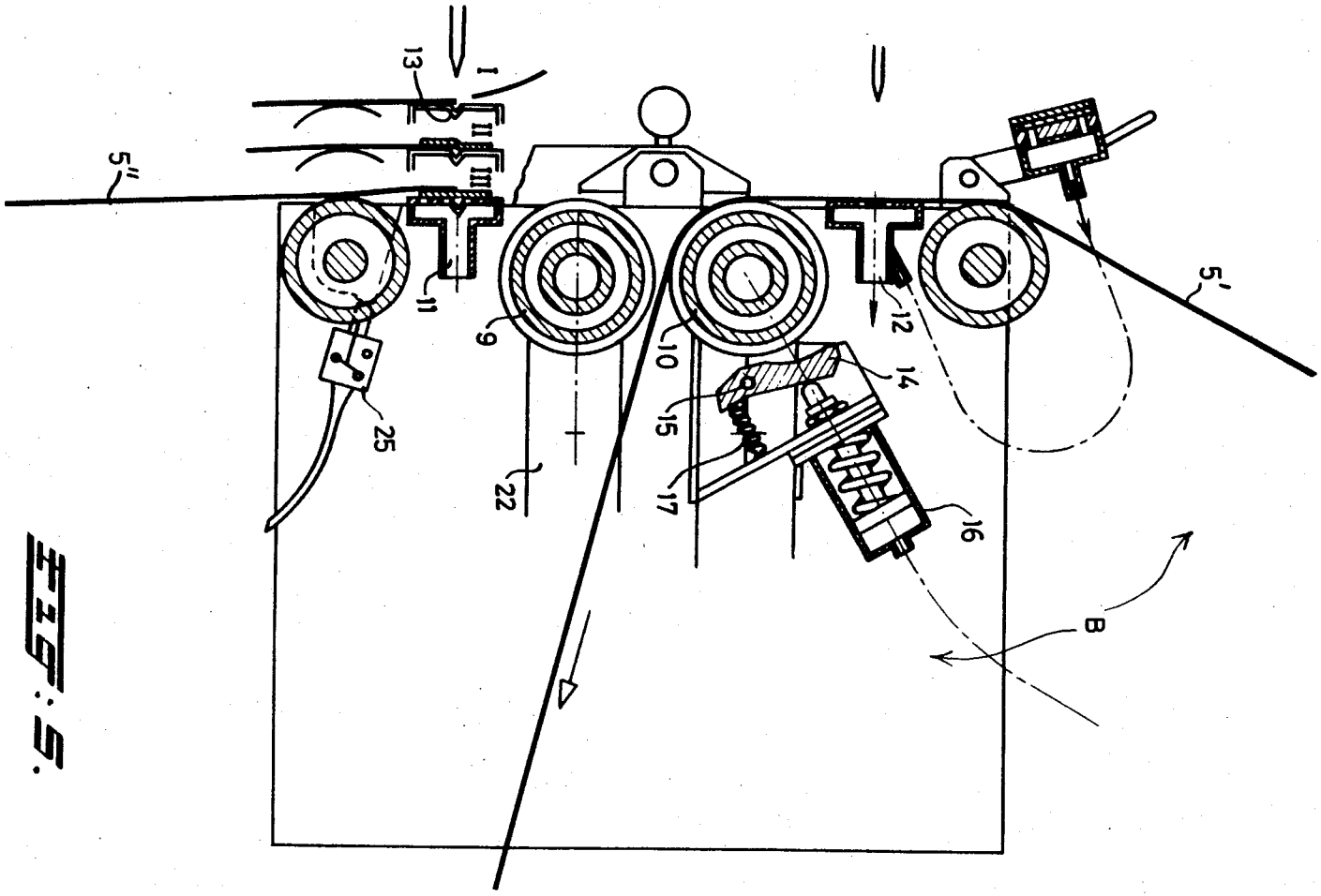
FIG. 5 shows another operating situation of the device according to FIG. 2.

In the structural respects the invention is present in the device 6 represented in the FIGS. 2 and 5 on an enlarged scale. FIG. 2 shows the situation corresponding to FIG. 1 whereas FIG. 5 represents the situation which occurs as soon as the upper roll 3 is nearly finished and an adherence (connection) must be established with the web deriving from the full lower roll 4. The problem to be solved is always the interconnection of the trailing (downstream) portion of a first material web (the terminating web 5') with the leading (upstream) portion of a second material web (the overtaking web 5'').

The device 6 is provided with two guiding rollers 9 and 10 which lie in path A (FIGS. 1–4) or B (FIGS. 5–7) starting from the supply roll 4 or 3 respectively to the accumulator 8. At a distance upstream with respect to the guiding rollers 9 and 10 respectively, a suction box 11 and 12 respectively is mounted along the path A and B respectively. These suction boxes 11, 12 are provided in the center with an anvil 13 (for instance a simple groove) for accurately severing perpendicularly the web resting upon the suction box. The two guiding rollers 9, 10 are positioned at a short distance one above the other in which the lower roller 9 is displaceable in upward direction until it touches the upper fixed roller 10 (forming together the clamping place 23). Near this fixed roller 10 a braking shoe 14 is displaceably mounted for arresting the roller 10. This shoe pivots around an axis 15 and can be pressed against the roller 10 by means of a pneumatic cylinder 16. A spring 17 urges the braking shoe 14 again free from the roller 10.

The device 6 also includes an auxiliary suction box 18 which is pivotally mounted upon an axis 19 such that the box 18 is capable of being pivoted into a position covering the upper suction box 12. There is further a displaceable screening frame 20 mounted upon the device 6 for covering at least the lower guiding roller 9 with suction box 11. The frame 20 is rotatable along an axis 21 (vide FIG. 3) and cooperates through a cam 24 with a switch 25. The lower guiding roller 9 is rotatably mounted upon a lever arm 22. With these means, the rollers 9 can be displaced between the positions shown in FIGS. 2 and 3.

Figure 7:
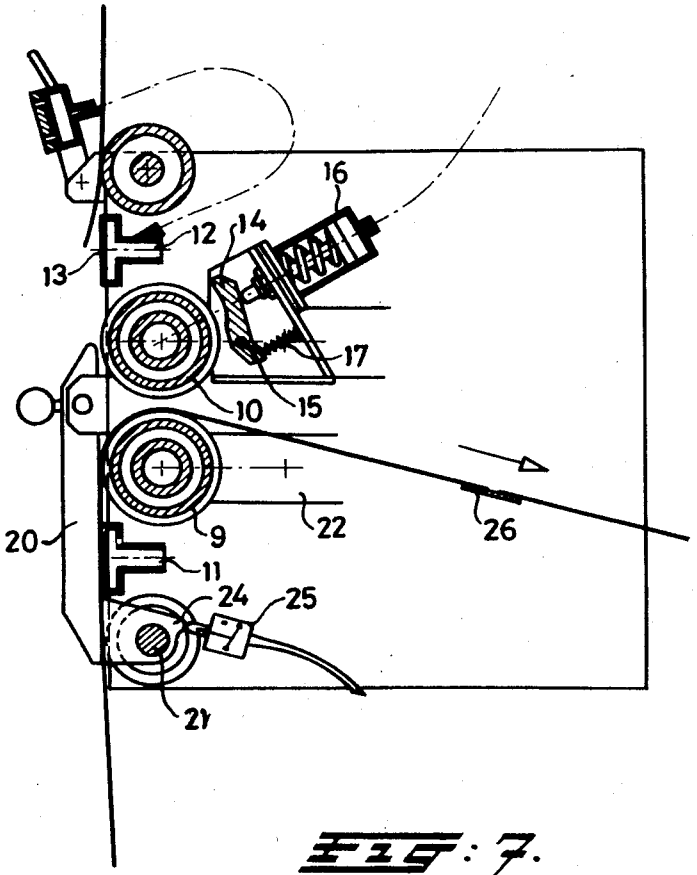
FIGS. 6 and 7 show once again two further phases of the situation according to FIG. 5.
Figure 6:
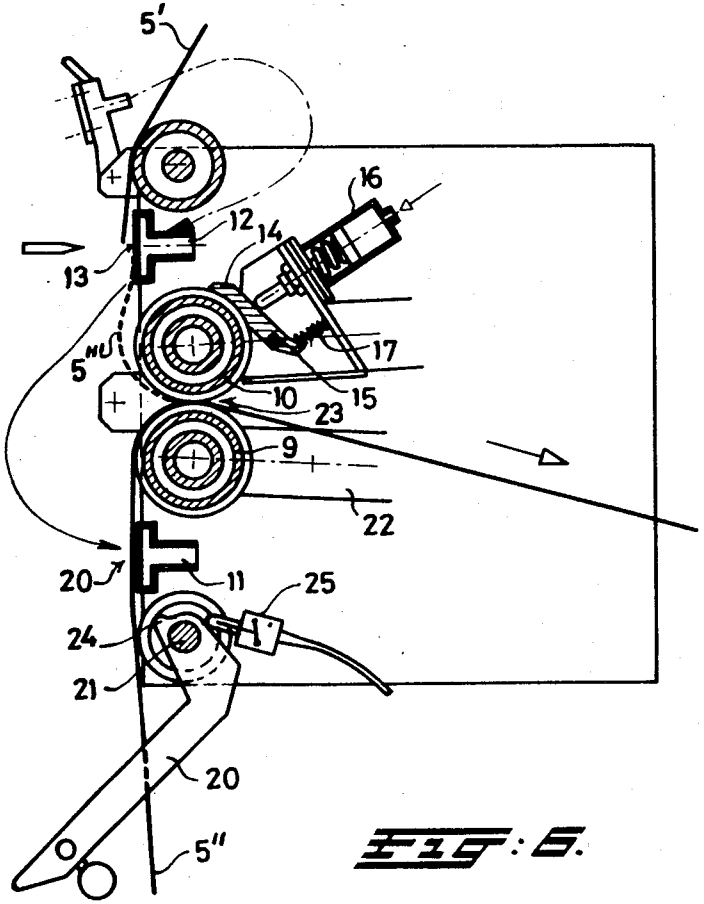

In the device 6 a sticking strip 26 is available which strip in the situation according to the FIGS. 1–4 is positioned with its non-adhering face upon the auxiliary suction box 18 and in the situation according to the FIGS. 5–7 can be applied upon the lower suction box 11. The severing of the terminating web 5' as well as of the overtaking web 5'' is performed by means of a knife (not shown) upon the anvil 13 of a respective suction box (vide FIG. 3 and FIG. 5).

Figure 4:
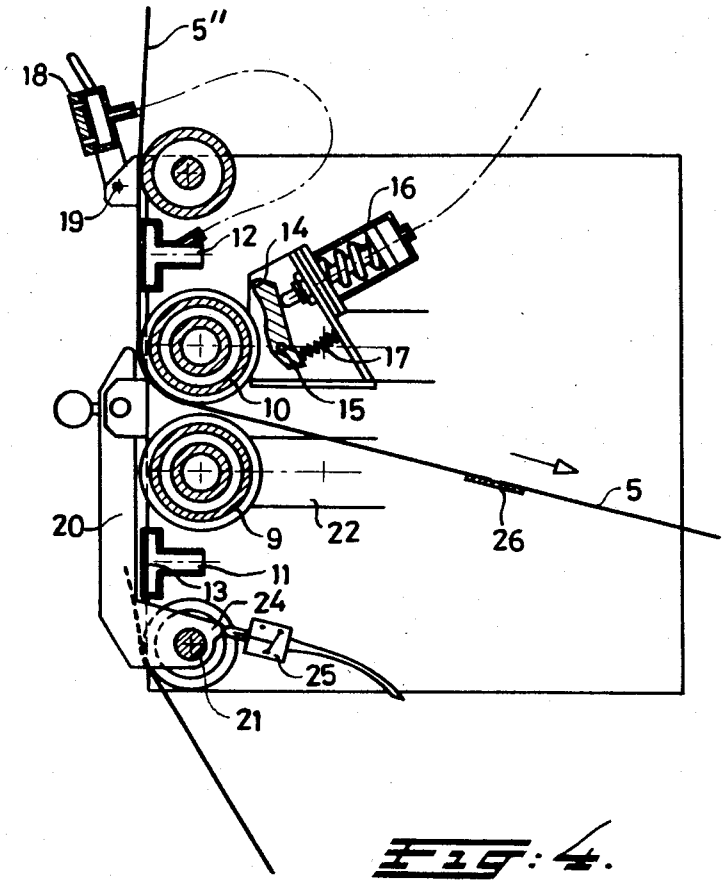
FIGS. 3 and 4 show two further phases of the interconnection of subsequent webs.

The operation of the sticking device 6 consists of a preparatory phase and an operating phase and will be discussed hereafter for the situation shown in the FIGS. 1–4 as well as in the situation according to the FIGS. 5–7. With respect to the first mentioned situation, the method comprises the following steps:

(a) preparatory phase:
- the vacuum for the suction boxes 12 and 18 is started;
- the overtaking web 5'' is positioned upon the suction box 12 and is cut through (severed) upon the anvil 13 by means of a knife not shown (vide FIG. 2);
- a sticking strip 26 is applied upon the auxiliary suction box 18 (FIG. 2);

(b) operating phase:
- the supply roll 4 of the terminating web 5' is arrested and by means of the accumulator 8 it is rendered possible to continue the printing procedure without interruption even while switching over from the lower roll 4 to the upper roll 3;
- the screening frame 20 is swung open, thereby turning on the switch 25 so that the cylinder 16 is energized;
- hereafter the terminating web 5' is fixed upon the clamping place 23 by means of the upward movement of the guiding roller 9 and the activation of the braking shoe 14 (FIG. 3);
- the web 5' is severed upon the anvil 13 of the suction box 11 (FIG. 3) by means of a knife;
- the trailing (downstream) portion 5''' of the terminating web 5' is deflected in upward direction upon the suction box 12 (the cut edges of the portions 5'' and 5''' are positioned in an abutting manner);
- the auxiliary suction box 18 and the sticking strip 26 are pivoted according to the arrow 27 such that the web portions 5'' and 5''' are interconnected (FIG. 3);
- the vacuum within the auxiliary suction box 18 is released and this box is hereinafter swung back without the sticking strip;
- the vacuum within the boxes 11 and 12 is released;
- the screening frame 20 is replaced again in its operating position (vide FIG. 4) in consequence of which the braking shoe 14 is lifted from the fixed roller 10 (FIG. 4);
- the interconnected webs 5' and 5'' start moving again and the accumulator 8 is again permitted to resume its position as shown in FIG. 1;
- after the passing of the sticking strip 26 through the clamping place 23 of the guiding rollers 9 and 10 pressed against each other, the roller 9 is lowered (vide FIG. 4).

In the FIGS. 5–7 the situation is shown following the one shown in FIG. 1. In the situation now to be described, the upper roll 5 is nearly empty and a connection must be established with the material web derived from the full lower roll 4. The description of the FIGS. 5–7 is completely corresponding to the FIGS. 2–4 with the difference that the terminating web 5' is now present at the upper side of the drawing and the overtaking web 5'' at the lower side. A further difference consists also in that in the situation according to FIGS. 5–7 the auxiliary suction box 18 can not function and the sticking strip 26 must now be positioned as it were "under" the overtaking web 5''. The actions to be performed are the following:

(a) preparatory phase:
- in three stages the overtaking web 5'' is severed and is provided with a sticking strip 26:
  1. the web 5'' is put upon the suction box 11 in which the vacuum is applied and the web is severed upon the anvil 13 (stage I);
  2. by hand the sticking strip 26 is put upon the suction box 11 (and upon the web 5'') with its non-adhering face (stage II);
  3. the web 5'' is drawn back from under the sticking strip 23 and is hereafter put upon the adhering face of the strip 23 (stage III);

(b) operating phase:
- the supply roll 3 of the terminating web 5' is arrested and by means of the accumulator 8 it is possible to proceed with the printing procedure without any interruption;
- the vacuum is applied within the box 12;
- the screening frame 20 is opened such that the switch 25 is closed and the cylinder 16 is energized;
- hereafter the terminating web 5' is fixed by moving upwardly the guiding roller 9 and by activating the braking shoe 14 (FIG. 6);
- the terminating web 5' is severed upon the anvil 13 of the suction box 12 by means of a cutting knife;
- the trailing (downstream) portion 5''' of the terminating web is deflected in downward direction and the end is pressed upon the fixing strip 26 which is lying upon the suction box 11 (the cutting edges are thereby positioned in an abutting manner one against the other);
- the screening frame 20 is swung back, the vacuum within the boxes 11 and 12 is released and the braking shoe 14 is lifted;
- the interconnected webs 5' and 5'' start to move and the accumulator 8 is once again enabled to resume its original position;
- after the passing of the sticking strip 26 through the clamping place 23 of the rollers 9, 10 pressed against each other, the roller 9 is finally moved downwardly (vide FIG. 7).

After some time, the situation shown in FIG. 1 is once again occurring, and the above described double cycle can repeat itself etc.

The advantages of the described device consists in that the adherence or connection of two successive material webs 5 can be brought about whilst using only one face (the lower face) of the web 5. By means of an appropriate determination of the length of the distances between the clamping place 23 of the guiding rollers 9, 10 on the one hand and the anvil 13 of both suction boxes 11, 12 (measured along the guiding rollers 9 or 10) on the other hand, one can achieve that a so called abutting connection is obtained between the terminating material web 5' and the overtaking web 5'' (as shown in the FIGS. 3 and 6). It is also possible to obtain an overlapping connection but in that case the exact location of the suction boxes 11 and 12 must be changed during the cycle.

What is claimed is:

1. Device for adhering to each other of the trailing end of a first material web (the expiring web) with the leading end of a second material web (the fresh web), by applying adhesive to only one predetermined side of each of said webs, in which each web is guided along a respective guide roller which is located in a path from a supply roll to an operating place, the adherence being performed during standstill of the webs, the device comprising two suction boxes each positioned along the path of a respective one of said webs for seizing said respective web by suction at a distance upstream with respect to the respective guide roller and each of said suction boxes being provided in its middle with an anvil which cooperates with a knife for accurately cutting perpendicularly through the respective seized web to form a respective cut edge of said web, and further comprising means for clamping the expiring web between the guide rollers and means including said suction box corresponding to said fresh web for receiving said two cut edges of said two seized webs in abutting relation so as to permit applying a one-side sticking strip to said adhesive receiving sides of both of said seized webs, in which the distances between the clamping place of both guide rollers on the one hand and the respective anvils of both suction boxes (measured along the guide rollers) on the other hand, are equal to each other.

2. Device according to claim 1, in which the two guiding rollers are mounted at a short distance above each other, in which the one roller is displaceable to come in touch with the other fixed roller and in that near the fixed roller a brake shoe is mounted displaceable for arresting the terminating web clamped between both rollers.

3. Device according to claim 2, which there is an auxiliary suction box which is pivotally mounted and capable of covering the upper suction box.

4. Device according to claim 3, further comprising a displaceable screening frame for covering at least the lower guiding roller and the respective suction box.

5. Method for operating a device for adhering to each other of the trailing end of a first material web (the expiring web) with the leading end of a second material web (the fresh web), by applying adhesive to only one predetermined side of each of said webs, in which each web is guided a respective guide roller which is located in a path from a supply roll to an operating place, the adherence being performed during standstill of the webs, the device comprising two suction boxes each positioned along the path of a respective one of said webs for seizing said respective web by suction at a distance upstream with respect to the respective guide roller and each of said suction boxes being provided in its middle with an anvil which cooperates with a knife for accurately cutting perpendicularly through the respective seized web to form a respective cut edge of said web, and further comprising means for clamping the expiring web between the guide rollers and means including said suction box corresponding to said fresh web for receiving said two cut edges of said two seized webs in abutting relation so as to permit applying a one-sided sticking strip to said adhesive receiving sides of both of said seized webs, in which the distances between the clamping place of both guide rollers on the one hand and the respective anvils of both suction boxes (measured along the guide rollers) on the other hand, are equal to each other, said method comprising a preparatory phase and a performing phase with the following steps:

(a) preparatory phase:

the vacuum in the suction boxes is switched on;

the fresh web is applied upon its respective suction box in which vaccum is supplied, after which the web is cut through upon the anvil in the middle of the box and the cut off portion is eliminated;

a one-sided sticking strip is positioned with its non-adhering face upon a vacuum applied auxiliary suction box;

(b) performing phase:

the advance movement of the expiring web is stopped;

the expiring web is perpendicularly cut through upon the anvil in the middle of its respective suction box;

the expiring web is fixed by clamping said web between the guide rollers which are rendered stationary by a braking shoe;

the cut off free end of the expiring web is loosened from its respective suction box and swung over to the other suction box such that the cut edges of both web ends are laying in abutting relation against each other;

the preliminary adherence of the ends of both webs is performed by bringing the sticking strip in contact with the stationary web ends;

the rotation of the guide rollers clamped to each other is again permitted and the definite adherence of the web ends is achieved during the passage of the adherence location through the clamping place;

the vacuum is released, the guide rollers are rendered free and the web again moves normally.

6. Method for operating a device for adhering to each other of the trailing end of a first material web (the expiring web) with the leading end of a second material web (the fresh web), by applying adhesive to only one predetermined side of each of said webs, in which each web is guided along a respective guide roller which is located in a path from a supply roll to an operating place, the adherence being performed during standstill of the webs, the device comprising two suction boxes each positioned along the path of a respective one of said webs for seizing said respective web by suction at a distance upstream with respect to the respective guide roller and each of said suction boxes being provided in its middle with an anvil which cooperates with a knife for accurately cutting perpendicularly through the respective seized web to form a respective cut edge of said web, and further comprising means for clamping the expiring web between the guide rollers and means including said suction box corresponding to said fresh web for receiving said two cut edges of said two seized webs in abutting relation so as to permit applying a one-sided sticking strip to said adhesive receiving sides of both of said seized webs, in which the distances between the clamping place of both guide rollers on the one hand and the respective anvils of both suction boxes (measured along the guide rollers) on the other hand, are equal to each other, said method comprising a preparatory phase and a performing phase with the following steps:

(a) preparatory phase:

the vacuum in the suction boxes is switched on;

the fresh web is applied upon its respective suction box in which vacuum is supplied, after which the web is cut through upon the anvil in the middle of the box and the cut off portion is eliminated;

a one-sided sticking strip is positioned with half of its adhering face adhered to the cut off end of the fresh web;

(b) performing phase:

the advance movement of the expiring web is stopped;

the expiring web is perpendicularly cut through upon the anvil in the middle of its respective suction box;

the expiring web is fixed by clamping said web between the guide rollers which are rendered stationary by a braking shoe;

the cut off free end of the expiring web is loosened from its respective suction box and swung over to the other suction box such that the cut edges of both web ends are laying in abutting relation against each other;

the preliminary adherence of the ends of both webs is performed by bringing the sticking strip in contact with the cut off free end of the expiring web;

the rotation of the guide rollers clamped to each other is again permitted and the definite adherence of the web ends is achieved during the passing of the adherence location through the clamping place;

the vacuum is released, the guide rollers are rendered free and the web again moves normally.

* * * * *